United States Patent [19]

Pradier

[11] Patent Number: 4,539,764

[45] Date of Patent: Sep. 10, 1985

[54] ADJUSTMENT APPARATUS FOR SKI BOOT

[75] Inventor: Serge Pradier, Alby-sur-Cheran, France

[73] Assignee: Salomon S.A., Annecy, France

[21] Appl. No.: 497,840

[22] Filed: May 25, 1983

[30] Foreign Application Priority Data

Jun. 2, 1982 [FR] France ..... 82 09984

[51] Int. Cl.[3] ..... A43B 5/04; F16B 1/00

[52] U.S. Cl. ..... 36/121; 403/4

[58] Field of Search ..... 36/117–121, 36/115; 403/4, 119, 162

[56] References Cited

U.S. PATENT DOCUMENTS

| | | | |
|---|---|---|---|
| 2,177,148 | 10/1939 | Newhall | 403/4 |
| 3,885,329 | 5/1975 | French | 36/120 |
| 3,945,134 | 3/1976 | Ramer | 36/118 |
| 4,117,890 | 10/1978 | Youngers | 403/4 |
| 4,334,368 | 6/1982 | Chalmers, II et al. | 36/121 |

FOREIGN PATENT DOCUMENTS

| | | | |
|---|---|---|---|
| 496094 | 12/1976 | Australia | 403/4 |
| 2166677 | 8/1973 | France . | |
| 2433311 | 3/1980 | France . | |

OTHER PUBLICATIONS

Kastinger Catalogue 1981–1982.

*Primary Examiner*—James Kee Chi

*Attorney, Agent, or Firm*—Sandler & Greenblum

[57] ABSTRACT

An adjustment apparatus for adjusting the attachment of a movable member to a stationary member, including a body having a movable opening therein. The opening can serve as a bearing for receiving a journal axis pin which allows a shank to pivot with respect to a shell base of a ski boot. Alternatively, the opening may serve as a means for receiving a projection from a closure device to attach a movable member to a stationary member. The opening is movable so that the axis of the journal pin can be changed, or the position at which the projection attaches to the two members can be adjusted. The body is adapted to fit within a complementary-shaped housing in one of the members so that it is flush with the member. The body has a slot therein, extending in the longitudinal direction of the body and adapted to receive a frame. The frame is adapted to rotate within the body around an axis transverse to the longitudinal axis of the body. The frame contains the opening. When the frame rotates, it simultaneously also becomes displaced in the longitudinal direction and thereby moves the opening from a first position to a second position along the longitudinal axis of the body. The body may also be reversed in the housing. If the slot is not centered in the body then by reversing the body, four positions for the opening can be obtained.

54 Claims, 10 Drawing Figures

FIG. 1.
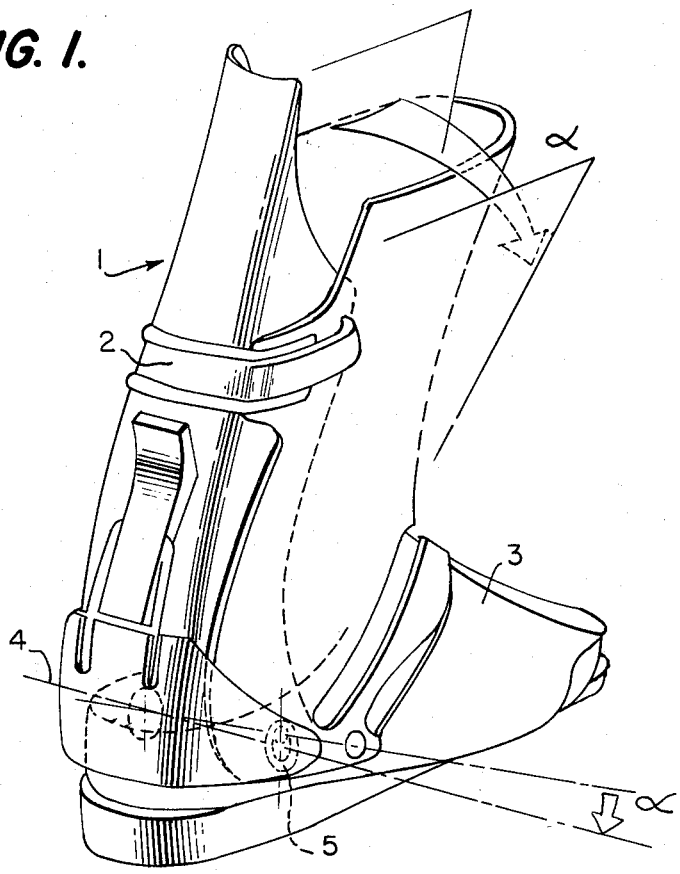
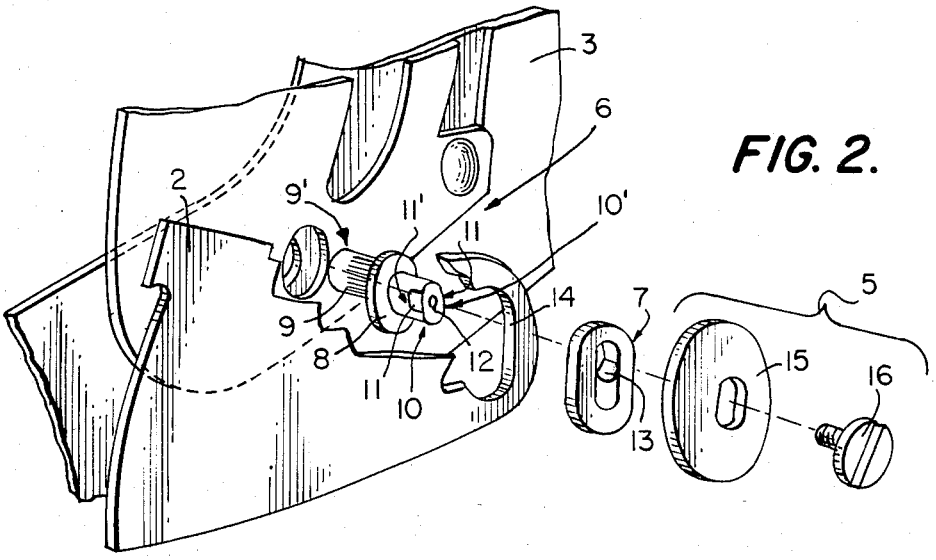
FIG. 2.

ADJUSTMENT APPARATUS FOR SKI BOOT

BACKGROUND OF THE INVENTION

1. Field of the Invention

The present invention relates to an apparatus for adjusting the attachment of a movable member to a stationary member. In one application the present invention adjusts the orientation of the axis around which a shank of a ski boot is journalled on a shell base. In another application the present invention adjusts the position of the attachment point of one member to another.

2. Description of the Prior Art

Ski boots are made from relatively rigid plastic materials because these rigid materials transmit as directly as possible the forces and movements of the skier's leg to the ski. However, the use of these rigid materials causes difficulty for skiers whose feet have a morphology that is not compatible with the standardized configuration of ski boot shells.

One type of ski boot in which this difficulty is evident is the type having a shank or sleeve journalled on a shell base so as to permit forward flexion movement of the leg and the corresponding backward movements of the leg. In some boots of this type the shank pivots freely around the journal axis, perpendicular to the longitudinal axis of the ski, and along a path in the longitudinal plane of the ski. In other boots of this type, the shank can be attached to the shell base at one given angular position with respect to a vertical axis, defined as the forward angle.

The ability to adjust the position of the skier's calf in relation to the foot by permitting forward flexion or adjusting the forward angle of the shank is not sufficient to make these types of boots comfortable for everyone because the morphology of skier's legs and feet are quite varied and include numerous irregular shapes, such as bowed legs or feet which point inward or outward.

In order to ski properly, these types of irregular morphologies must be compensated for. This is particularly true for very good skiers, who are sensitive to the least lateral deviation of their legs and feet from a vertical axis, when their feet and legs lean forward with respect to the ski.

There already exist several adjustment apparatus for adjusting the axis around which the shank is journalled on the shell base so as to compensate for foot irregularities that cause lateral deviation of the foot and leg from a vertical axis when leaning forward. These known adjustment apparatus have been adopted by some boots already on the market. One example is described in French Pat. No. 2,166,677, and comprises one or several oblong holes located in the shell base. Grooves located on the outer walls of the shell base cooperate with notches located on the inside of the walls of the journalled shank. Although this arrangement works, it is difficult to see the notches and grooves, and to choose a particular notch and groove when adjusting the apparatus. The skier must, therefore, proceed blindly to determine how much of a change in the angular orientation of the journal axis is best suited to his needs.

A second angular adjustment system for the shank of a boot is disclosed in the Kastinger catalog of boots in his 81–82 collection. These boots have small oblong inserts which contain a hole that is not centered with respect to the outer contour of the insert. This hole is adapted to receive the journal axis pin of the shank. In this type of arrangement, the adjustment of the orientation of the journal axis is accomplished by using a set of three types of different inserts which permit the journal axis to assume five possible angular positions. However, in order to change the orientation of the journal axis, inserts must be removed and replaced by the other inserts. This type of adjustment is inconvenient because the skier constantly needs to maintain a complete set of different types of inserts to change the orientation of the journal axis.

SUMMARY OF THE INVENTION

It is an object of the present invention to overcome these disadvantages of the prior art by providing a ski boot having an adjustment apparatus for adjusting the orientation of the journal axis around which the shank pivots when the skier leans forward, that is simple and easy to use.

It is another object of the invention to provide a shank that journals on a shell base and that is correctly centered on the shell base; and to provide an adjustment apparatus that is perfectly integrated into the walls of the shank and the shell base, and is of the same thickness thereof, so that no part of the apparatus projects out from the lateral faces of the boot.

A still further object of the present invention is to improve and perfect the existing oblong insert system by providing one insert with the ability to be adjusted to one of four different positions, thereby providing four different orientations of the journal axis. It is still another object of the present invention to provide inserts which can be adjusted to four different adjustment positions, by using a noncentered opening in the insert whose position can vary with respect to the outer contour thereof. Furthermore, it is another object of the present invention to provide inserts that can make fine adjustments in the orientation of the journal axis by being able to move less than the radius of a journal axis pin between adjustment positions.

To accomplish these goals, the present invention is provided, which relates to an adjustment apparatus for a ski boot having a shank member journalled on a shell base member, and which is designed to adjust the orientation of the axis around which the shank pivots when the skier and shank lean forward. The apparatus can also be used to improve the ability to adjust other elements of the boot, such as the position of the tightening or closure hooks, the forward position of the shank, etc . . . , or to improve the ability to adjust the attachment of a movable member to a stationary member in a wide variety of devices.

A brief overview of some of the main features of the invention will now be given, and then a more detailed summary will follow.

The adjustment apparatus of the present invention comprises an adjustment element which is preferably either oblong or round, and which is adapted to be placed in a housing located in the wall of at least one of the parts of the boot. The housing has a shape corresponding to the shape of the exterior of this adjustment element. This round adjustment element is provided with a circular opening, adapted to serve, for example, as a bearing or support for a journal axis pin, or as a bearing or support for a centering and positioning projection of a set-in element. This opening is adapted to be shifted with respect to the center of the round or oblong adjustment element. It is this change in the position of the opening that changes the orientation of the journal axis or the position of the projection of the set-in element. The position of the opening is adapted to be displaced in the direction of the of the longitudinal axis of the adjustment element in response to the movement of a frame in which the opening is embedded. The frame is arc-shaped and is adapted to be simultaneously pivotable around an axis transverse to the longitudinal axis of the adjustment element, and displacable in the direction of the longitudinal axis of the adjustment element.

A detailed summary will now be given of several different embodiments of the invention that incorporate the above-mentioned adjustment apparatus. The first embodiment relates to an adjustment apparatus for adjusting the attachment of a movable member to a stationary member. This adjustment apparatus comprises a body and a frame. The body is adapted to fit within a complementary-shaped housing in one of the members, and the body has a slot therein extending approximately in the direction of the longitudinal axis of the body. The frame is adapted to fit into the slot, and has a volume less than the volume of the slot. The frame is adapted to simultaneously rotate around an axis substantially or exactly transverse to the longitudinal axis of the body and to move in the longitudinal direction of the longitudinal axis of the body.

The frame has an opening therein which is adapted to receive an element attached to the other member, whereby the position of the frame determines the longitudinal position of the opening. The element is adapted to be displaced when engaged in the opening and when the opening is displaced, and is adapted to move freely in the opening. The opening is preferably circular.

The opening is adapted to receive the element when it is in a first and second position that are spaced apart in the longitudinal direction. These first and second positions in which the opening is adapted to receive the element correspond to first and second positions of the frame in which the longitudinal axis of the frame is substantially parallel to the longitudinal axis of the body. The second position of the frame is obtained by rotating the frame by 180° from the first position. When this is done, the opening is displaced to the opposite side of the frame, as compared to its first position.

The body of the adjustment element is adapted to be attached to one of the members so that the longitudinal axis of the body is substantially vertical, and, therefore, the first and second positions of the opening are substantially vertically spaced from each other. Thus, if the body of the adjustment apparatus is attached to the shank and the element that is received in the opening is attached to the shell base member, then by moving the opening from its first to its second position, the opening would move vertically and change the angular orientation of the axis around which the shank pivots.

The body comprises two longitudinal ends, and in one embodiment the slot is adapted to be positioned closer to one longitudinal end of the body than the other longitudinal end. This asymmetrical placement of the slot permits the opening to be adjusted to four separate positions, as will be discussed below.

One longitudinal end of the body is called the front longitudinal end, and the other is called the rear longitudinal end. The body is adapted to be placed in a housing of one of the members and is adapted to be removed from the housing and replaced in the housing with the position of the front and rear longitudinal ends reversed. Thus, when the body is in its original position, the frame may be pivoted so as to move the opening from a first to a second position. If the body is then taken out of the housing and the front and rear longitudinal ends reversed, then because the slot is asymmetrically positioned in the body, the new first and second positions of the opening will not be identical to the original first and second positions of the opening. Consequently, the adjustment apparatus provides four positions of the opening, each spaced from the other in the longitudinal direction of the body.

Furthermore, these four positions of the opening can be ordered in terms of their distance from one longitudinal end of the slot. From this point of view, the opening may occupy one of four successive positions. The distances between the centers of the opening in its first and second successive positions, second and third successive positions, and the third and fourth successive positions in the longitudinal direction of the body (or in other words, the distances between the center of the opening in successive adjacent positions) are less than the radius of the element adapted to engage the opening. In addition, or alternatively, the distances between the center of the opening in first and second successive positions, second and third successive positions, and the third and fourth successive positions of the opening (or in other words, the distances between the center of the opening in successive adjacent positions) are less than half of the width of the opening.

In an alternative embodiment, the slot is positioned equidistantly from each longitudinal end of the body. When the frame is rotated into its first and second positions, which are 180° apart, in which the opening is adapted to receive the element, the first and second positions of the opening are positioned symmetrically on opposite sides of the transverse plane of symmetry passing through the body.

In order to facilitate the rotation and longitudinal displacement of the frame in the body, the frame further includes two projections, each of which extend laterally from opposite sides of the frame, perpendicular to the longitudinal axis of the frame. These projections are adapted to slidingly engage a slide opening in the side of the frame so that the frame is adapted to rotate around these projections. When the frame and the opening in the frame rotate 180° from the first to the second position, the projections and frame simultaneously rotate and become displaced in the longitudinal direction of the body. The projections may be cylindrical, and the slide openings may be located in approximately halfway between the bottom and top of the frame.

The length of the slide openings is greater than or slightly greater than the distance between the center of the circular opening in its first position and the center of the circular opening in its second position. This ensures that the frame will be able to rotate freely and simultaneously be longitudinally displaced. In addition, the frame and slot may be oblong-shaped to include two arc-shaped longitudinal ends each of which has the same radius as the circular opening. Also, the circular opening can be located in one of the longitudinal arc-shaped ends of the frame or slot. The length of the slide openings may also be greater or slightly greater than the distance between the centers of the two arc-shaped ends. When this condition is met, the frame may freely rotate in the body and simultaneously be longitudinally displaced.

The body, frame, and slot may be oblong-shaped, or, alternatively, the frame, the body in the opening, and the slot may be parallelepipedic in shape.

Another embodiment of the present invention relates to the use of the adjustment apparatus described above in a ski boot having a shank member, a shell base member, and a journal element attached to one of these members through which an axis passes around which the shank is journalled and which is adapted to change its angular orientation. The apparatus is adapted to change the orientation of the axis passing through the journal element around which the shank member is journalled on the shell base member. In this embodiment, the apparatus comprises a body and a frame. The body is adapted to be attached to the other of the members and has a slot therein. The frame is adapted to engage the slot and has an opening therein which is adapted to receive the element. The frame is adapted to change its position within the slot in such a manner so as to change the position of the opening, thereby changing the orientation of the journal axis, when the element engages the opening. When the adjustment apparatus of the present invention is used in this environment, it includes all of the features mentioned above in connection with the apparatus for adjusting the attachment of a movable member to a stationary member. In addition, in this embodiment, the body is adapted to fit within a complementary-shaped opening in the wall of one of the members, and the adjustment apparatus may be used in combination with a second adjustment apparatus, each of which are attached to one of the members on the opposite sides thereof.

When used with such a ski boot, this adjustment apparatus may be attached to the shank, and the journal element may be adapted to be attached to the shell base.

Another embodiment of the present invention relates to a ski boot which incorporates this adjustment apparatus. The ski boot comprises a shell base member, a shank member, an adjustment means, and a journal element. The shank member is adapted to journal on the shell base member by journalling on the journal element around a journal axis passing through the journal element. The journal element is adapted to be attached to one of the members and is adapted to change the orientation of the journal axis. The adjustment means changes the orientation of the journal axis. The adjustment means comprises a body which is adapted to be attached to the other member. The body has an opening therein adapted to receive the element. The body is also adapted to change the position of the opening, thereby changing the orientation of the journal axis when the element is received in the opening. This ski boot which incorporates the adjustment apparatus of the present invention discussed above includes all of the features of the adjustment apparatus explained above with respect to the other embodiments. In addition, one of the members to which the body is attached has a complementary shaped housing that can be in the shape of a cross or a "T", wherein the horizontal and vertical portions of the housing are each complementary to the shape of the body.

BRIEF DESCRIPTION OF THE DRAWINGS

The invention will be better understood in connection with the detailed description of the preferred embodiments which follows and with the attached drawings, illustrating, by way of non-limiting example, some of the embodiments of a ski boot equipped with the present invention, wherein:

FIG. 1 is a perspective view of a ski boot equipped with the adjustment apparatus of the present invention which is adapted to change the angular orientation of the axis around which the shank pivots as the skier leans forward;

FIG. 2 is an exploded partial perspective view illustrating the assembly of the various elements of the adjustment apparatus of the present invention;

DETAILED DESCRIPTION OF THE PREFERRED EMBODIMENTS

Figure 3:
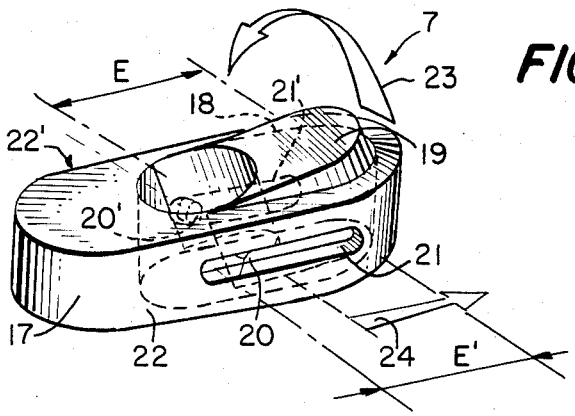
FIGS. 3 and 4 illustrate two perspective views of the adjustment element of the invention, in its two different adjustment positions.

The adjustment apparatus of the present invention can be used most generally to adjust the attachment of a movable member to a stationary member. One specific application is in providing an adjustment apparatus for changing the orientation of the axis around which a shank member of a ski boot is journalled on a shell base member, and in providing a ski boot so equipped. Such an embodiment is illustrated in FIGS. 1 and 2.

FIGS. 1 and 2 disclose a boot 1 comprising a shank member 2 journalled on a shell base member 3. The adjustment apparatus 5 of the present invention is attached on the boot where shank 2 pivots around base member 3.

As can be seen in FIG. 1, adjustment apparatus 5 is adapted to change the orientation of journal axis 4 by angle $\alpha$, thereby causing the shank and leg of the skier to shift laterally through an angle $\alpha$ as the leg and shank lean forward with respect to the shell base.

In this embodiment, shank 2 pivots about a journal element which can be attached to either shank member 2 or shell base member 3. Adjustment apparatus 5 can also be attached to either shank 2 or shell base member 3. However, the journal element and the adjustment apparatus are not attached to the same member. Thus, when the journal element is attached to one member, such as shank member 2, adjustment apparatus 5 is attached to the other member, such as shell base member 3.

In FIGS. 1 and 2, journal element is a journal pin 6 in the form of a cylindrical rod, and is adapted to be attached at one end to shell base member 3. Journal axis 4 passes through the longitudinal axis of rod 6, and rod 6 is provided on at least one side of the boot. Cylindrical rod 6 is adapted to cooperate with adjustment element 7 of adjustment apparatus 5, as will be discussed hereinbelow. On the other side of the boot, either a simple journal rivet or a second adjustment apparatus 5 can be provided (not shown). Providing a second adjustment apparatus 5 on the other side of the boot which is adapted to cooperate with another rod 6 increases the number of possible angular positions the journal axis may assume.

Cylindrical rod 6 is equipped at its midpoint with a shoulder 8 which serves as a stop for the knurled inside section 9. Section 9 is adapted to be attached inside the wall of the shell base 3 by riveting end 9' of shank 2. Rod 6 is riveted to base 3 such that rod 6 is pivotally attached to the lower shell so that shank 2 is adapted to change the angular orientation of its journal axis as will be explained below.

The outer part 10 of rod 6 which extends in front of shoulder 8 has at its end 10' two flat pieces 11. The end of rod 8 opposite from end 9' comprises an internal threading 12 which is coaxial with cylindrical rod 6. That portion of the outer part 10 of rod 6 which is not flat is adapted to engage an opening 13 of adjustment element 7. Conversely, opening 13 is adapted to receive element 6. Opening 13 acts as a bearing for journal element 6 so that adjustment element 7 and shank 2 which is attached to adjustment element 7 journal on journal element 6 and shell base 3. Adjustment element 7 is adapted to engage a complementary shaped housing 14 located in the mobile section of shank 2. Housing 14 corresponds to the external shape of adjustment element 7 and element 7 corresponds to the shape of housing 14. Adjustment element 7 is designed so as to have the same thickness as housing 14, so that when adjustment element 7 is placed in housing 14, it is flush with the outer surface thereof. In this way, adjustment apparatus 5 is perfectly integrated into the walls of the shank.

To ensure the cooperation of journal element 6 and adjustment element 7, a stop washer 15 is provided, which has a larger diameter than the largest dimension of adjustment element 7. Washer 15 is adapted to hold adjustment element 7 in its housing as follows. Washer 15 is held in place against face 11' of flat portion 11 of outer part 10 of rod 6 by stop screw 16 which screws into inner threading 12 of said journal element 6. In this manner journal element 6 engages adjustment element 7 so that element 7 and shank 2 may pivot therearound. Adjustment element 7 is preferably oblong and of a height at least equal to the thickness of the wall in which it is encased.

The construction and operation of adjustment element 7 will now be discussed. Adjustment element 7 comprises a body 17, adapted to be attached to the member to which the journal element is not attached. In this case, because journal element 6 is attached to base 3, body 17 is attached to shank 2. Body 17 is adapted to fit within a complementary shaped housing 14 in shank 2. Body 17 is preferably oblong-shaped, having two arc-shaped or cylindrical longitudinal end portions, although other shapes are possible and will be discussed below. Body 17 also contains opening 13 therein which is adapted to receive journal element 6 so as to pivot therearound. Opening 13 is preferably circular. Body 17 acts as an adjustment apparatus because it is adapted to change the position opening 13, thereby changing the orientation of journal axis 4 when journal element 6 is received in opening 13. This ability of body 17 to change the position of opening 13 is a result of the structure of body 17, which will now be discussed.

Figure 4:
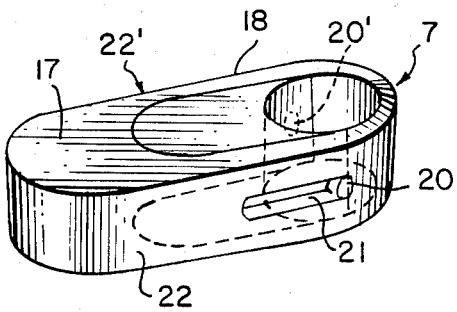

Body 17 comprises a preferably oblong-shaped slot 18 therein, as seen in FIGS. 3 and 4 extending approximately or exactly in the longitudinal direction of the longitudinal axis of body 17. Slot 18 has two arc-shaped or cylindrical longitudinal end portions of the same radius, and this radius is preferably equal to the radius of circular opening 13. Oblong-shaped slot 18 is preferably not centered within body 17, or in other words, the slot is positioned closer to one longitudinal end portion of body 17 than the other longitudinal end portion. Alternatively, slot 18 could be centered within body 17, so that each end of slot 18 is equidistant from each longitudinal end portion of body 17. The position of slot 18 in body 17 determines the position of opening 13 with respect to the outer contours of body 17, and the number of possible positions opening 13 can assume, thereby determining the degree and number of charges that can be made in the orientation of the journal axis. This can be understood by explaining the role of frame 19.

A frame 19, also seen in FIGS. 3 and 4, is adapted to fit into or be engaged in slot 18, and is also preferably oblong in shape, and has the same thickness as body 17. Frame 19 contains opening 13 therein, and is adapted to move within slot 18, thereby changing its position and the position of opening 13. In order to be adapted to move therein, frame 19 has a volume less than the volume of slot 18. Frame 19 is adapted to move within slot 18 by simultaneously combining two types of movements. First, frame 19 is adapted to rotate or pivot around an axis transverse to the longitudinal axis of body 17. This pivoting is shown by arrow 23 in FIG. 3. Second, frame 19 is also adapted to move at the same time in the longitudinal direction along the longitudinal axis of body 17.

This occurs because frame 19 has two cylindrical journal projections 20, 20' each of which extend laterally from opposite sides thereof from that portion of frame 19 where the arc-shaped longitudinal end begins and the width of frame 19 begins to narrow. Each of these projections 20, 20' slidingly engage parallel slide openings 21, 21', respectively, provided on each side 22, 22' of body 17, and which are preferably positioned half way up each side 22, 22'. The length of slides 21, 21' is E' as seen in FIG. 3, and is chosen to be greater than or slightly greater than the distance E between the centers of each arc-shaped longitudinal end of slot 18. This distance E is called the interaxis of body 17. Alternatively or in addition, the length of slides 21, 21' is chosen to be greater than the distance between the center of opening 13 when it is in a first position for receiving journal element 6 (for example, as seen in FIG. 3), and the center of opening 13 when it is in a second position for receiving journal element 6 (for example, as seen in FIG. 4).

Because the length of slides 21, 21' is slightly greater or greater than the interaxis of slot 18, and because frame 19 is also smaller than slot 18, frame 19 may move away from the inner wall of slot 18, where it is in a first position, pivot in the direction of arrow 23 around projections 20, 20', and simultaneously push projections 20, 20' backwards in slides 21, 21' in the direction of arrow 24, so that projections 20, 20' and opening 13 occupy a second position on the opposite side of body 17, when frame 19 pivots through 180°. In this way, frame 19 can position opening 13 in two longitudinally spaced apart positions. When the longitudinal axis of body 17 is mounted vertically in housing 14, as seen in FIGS. 1 and 2, opening 13 can occupy two vertically spaced positions. When journal element 6 engages in opening 13, its first position and then in its second position, the orientation of journal axis 4 is changed. It should be noted that the first and second positions in which opening 13 is adapted to receive element 6 correspond to positions of frame 19 in which the longitudinal axis of frame 19 is parallel to the longitudinal axis of body 17 in embodiments shown in FIGS. 3 and 4.

Figure 5:
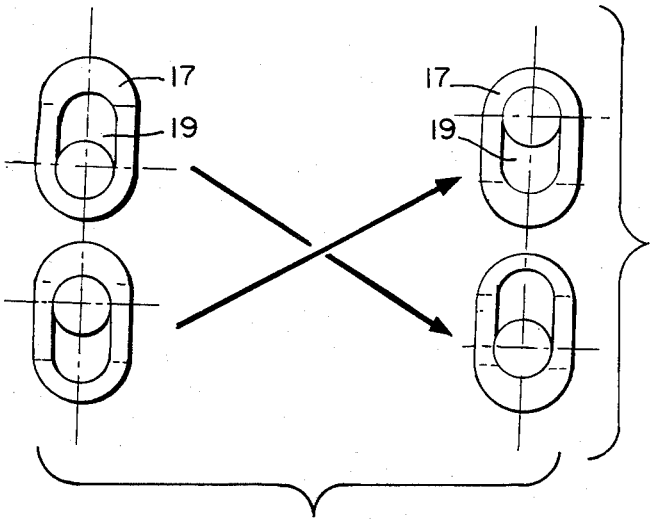
FIG. 5 illustrates the four different adjustment positions of a single adjustment element.

Thus, a single adjustment element of the present invention allows the skier the choice of two journal axes. This number of possible journal axes can be doubled to four, if slot 18 is not centered and body 17 is removed from housing 14 and reversed so that its front and rear longitudinal ends are reversed. This reversal permits opening 13 to assume two additional positions. All four positions are shown in FIG. 5. The two bodies 17 in the right column have their front and rear longitudinal ends reversed with respect to the bodies 17 in the left column. Thus, body 17 and opening 13 can assume four positions which correspond to four different orientations that journal axis 4 can assume.

When frame 19 is rotated 180°, a fairly large change is made in the orientation of journal axis 4. When body 17 is reversed, small, fine adjustments can also be made in the orientation of journal axis 4. This can be seen as follows. Consider the body 17 in the upper left corner of FIG. 5. Opening 13 is positioned at the bottom of slot 18. If frame 19 is rotated 180° and body 17 is reversed, as seen in the lower right corner of FIG. 5, opening 13 is also positioned at the bottom of slot 18. However, because slot 18 is closer to one end of body 17 than the other, when body 17 is reversed, opening 13 is positioned slightly higher than in its previous position. Thus, two positions of opening 13 can be obtained that are close together, so that fine adjustments can be made in the orientation of axis 4. This process can be repeated when opening 13 is positioned at the top of slot 18, as seen in the lower left corner and upper right corner of FIG. 5.

Figure 6:
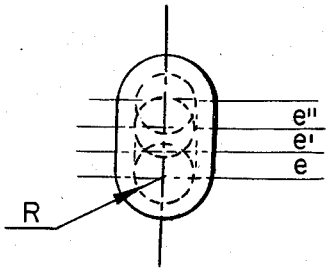
FIG. 6 illustrates the fine adjustments that can be made in the position of the opening and the orientation of the journal axis, which are controlled by the adjustment element.

These four positions of opening 13 can be ordered in terms of their distance from one longitudinal end of frame 19. When this is done, as in FIG. 6, it is seen that opening 13 can assume four successive positions, called first, second, third and fourth successive positions or circles along the longitudinal axis of body 17. These successive positions are so close together that the four successive circles overlap. The distance between the centers of adjacent circles is e, e′, e″, and these distances, which correspond to angular changes in the orientation of journal axis 4, are less than the value R of the radius of cylindrical rod 6 and/or less than half the width of opening 13. Thus when opening 13 moves between two successive positions to engage rod 6, it moves through a distance less than its radius. Because this change in the orientation of journal axis 4 is small, the adjustment apparatus of the present invention has the ability to make fine adjustments in the orientation of journal axis 4.

Lastly, it should be noted that with this type of adjustment apparatus, although element 7 as well as frame 19 are constantly subjected to compression forces, their deformation under these forces is limited because of the structure and arrangement of the apparatus.

Figure 8:
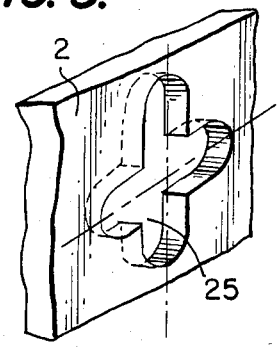
FIGS. 8 and 9 illustrate two alternative embodiments of the invention which show alternative housings for the adjustment element.
Figure 9:
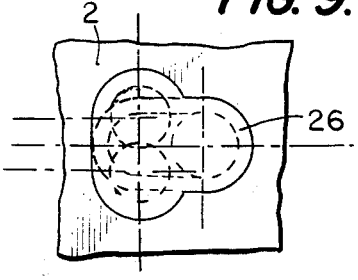

The embodiment described above relates to the use of the adjustment apparatus of the present invention in a ski boot to change the position of opening 13 in one longitudinal direction, e.g. vertical. However, the invention is not so limited, and it is within the scope of the invention to use it to change the position of the adjustment element in more than one direction. In one embodiment, a housing adapted to receive an adjustment element, can be provided so as to allow the adjustment element to move to more than two positions in more than one direction. FIG. 8 illustrates such a housing 25 in the shape of a cross located in the wall of shank 2. Both the horizontal and vertical positions of the cross are complementary to the shape of body 17 so that body 17 can be placed in either portion. Another embodiment is illustrated in FIG. 9, showing a housing 26 in the shape of a T. Again, both horizontal and vertical positions are complementary to the shape of body 17. Furthermore, it is within the scope of the invention to arrange the axes of each horizontal and vertical portion of the housing in the walls of the shank so that they are not necessarily placed in a horizontal and/or vertical direction with respect to the plane of the sole of the boot, but rather are oriented in oblique directions to the plane of the sole of the boot.

The adjustment apparatus of the invention is not limited to adjusting the angular orientation of the journal axis of the shank. It is within the scope of the present invention to adjust the attachment of any movable member to a stationary member, such as are found in closure systems, such as latch hooks, toothed rack hooks, etc . . . , which sometimes necessitate supplementary, fine adjustments. Such an embodiment is shown in FIG. 7.

Figure 7:
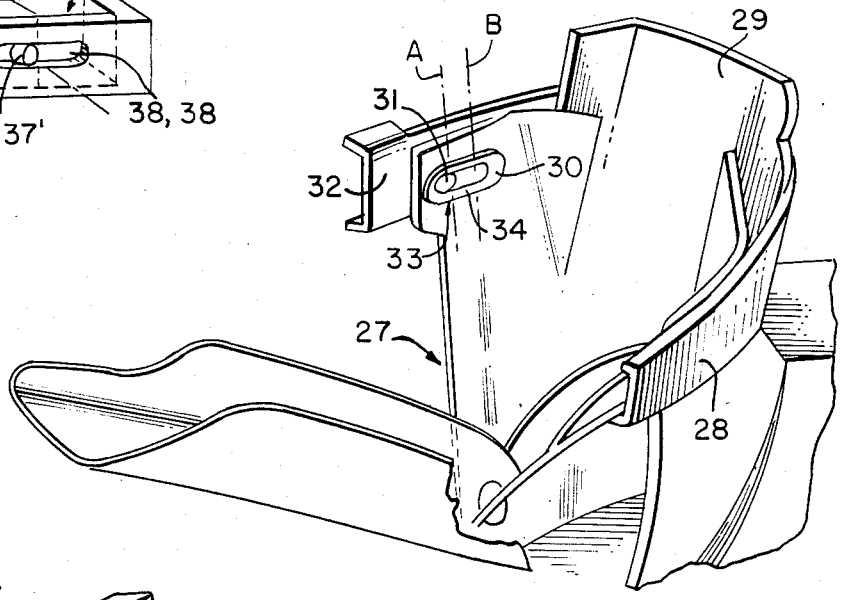
FIG. 7 shows an alternative use of the adjustment apparatus of the invention in which the adjustment apparatus is used to adjust the position of a closure system.

In FIG. 7, a ski boot 27 of the type with an opening in the back thereof comprises a tightening and closing means 28 for the upper part of shank 29 on the skier's calf. Frequently it is desirable for the closing means to be adapted to the morphology of a skier who will not be satisfied by the amount of tightening obtained with conventional toothed rack hooks. Therefore, it becomes desirable to be able to adjust the position of the toothed rack hook to increase the tightening thereof. To accomplish this, an adjustment element 30 of the present invention is placed in the wall at the top of the shank 29. Adjustment element 30 contains movable opening 33 and movable frame 34 therein. Opening 33 is adapted to engage an anchoring projection 31 of a tightening strap 32 at a position indicated by the letter A in FIG. 7. In this embodiment, opening 33 acts as an anchoring bearing or support for projection 31.

If this position is not acceptable because the calf of the leg has a larger circumference than can accommodate the strap 32 being attached to the shank at location A, the skier moves the attachment point of strap 32 and shank 29 from position A to position B by disengaging anchoring projection 31 from strap 32 and pivoting frame 34 as was described above with reference to FIGS. 3 and 4. Once anchoring opening 33 is in its new position, the skier can reattach strap 32 to projection 31 and tighten it the desired amount. It is evident that a second adjustment apparatus can be provided on the other side of the shank which would increase the number of adjustments that are possible.

Figure 10:
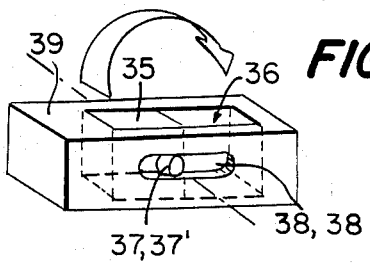
FIG. 10 illustrates a perspective view of another embodiment of the adjustment element having a parallelepipedic shaped frame.

It should be noted that the invention is not limited to the embodiments described and illustrated above. Specifically, the movable frame which determines the position of the opening 13 or anchoring opening 33 need not be oblong, cylindrical, or round in shape; it is within the scope of the present invention to provide a body 39, a frame 35, an opening and slot 36, and projections 37, 37′ in slots 38, 381 which are in the shape of a parallelepiped 35 as can be seen in FIG. 10 or any other shape. In this way the invention can be applied to domains other than ski boots where there is a need for an adjustment apparatus which must be completely integrated into the contours of objects, for example in the domain of toys, mechanics etc . . . .

Although the invention has been described with respect to particular means and embodiments, it is to be understood that the invention is not limited to the particulars disclosed and extends to all equivalents falling within the scope of the claims.

I claim:

1. An adjustment apparatus for a ski boot having a shank member rotatable about an axis, a shell base member, and a journal element attached to one of said members around which said shank member is journalled, wherein said apparatus comprises means for changing the orientation of said axis around which said shank member rotates, and wherein said means comprises:

a body attached to the other of said members and having a slot therein; and a frame engaging said slot and having an opening therein for receiving said journal element, wherein said frame comprises means for changing the position of said frame within said slot in such a manner so as to change the position of said opening, thereby changing the orientation of said axis when said journal element engages said opening.

2. The apparatus of claim 1 wherein said slot extends approximately along the longitudinal axis of said body, said frame having a volume less than the volume of said slot and said frame being adapted to rotate around an axis transverse to the longitudinal axis of said body.

3. The apparatus of claim 2 wherein when said frame rotates around said transverse axis, said frame is also adapted to be displaced in the longitudinal direction of said body simultaneously.

4. The apparatus of claim 3 wherein said opening is adapted to be moved between first and second positions spaced apart in the longitudinal direction of said body, wherein said opening is adapted to receive said element when said opening is in said first and second positions.

5. The apparatus of claim 4 wherein said first and second positions correspond to first and second positions of said frame in which the longitudinal axis of said frame is substantially parallel to the longitudinal axis of said body, and said second position is obtained by rotating said frame over 180° from said first position.

6. The apparatus of claim 5 wherein said body is adapted to be attached to one of said members so that the longitudinal axis of said body is substantially vertical, whereby said first and second positions of said opening are substantially vertically spaced from one another.

7. The apparatus of claim 6 wherein said body has two longitudinal ends and said slot is adapted to be positioned closer to one longitudinal end of said body than the other longitudinal end of said body.

8. The apparatus of claim 7 wherein said body is adapted to be placed in a housing in one of said members, wherein said body has front and rear longitudinal ends and is adapted to be removed from said housing and is adapted to be replaced in said housing with the position of said front and rear longitudinal ends reversed, whereby said opening can be positioned in first, second, third, or fourth successive positions along the longitudinal direction of said body.

9. The apparatus of claim 8 wherein the distances between the center of said opening when said opening is in said first and second successive positions, second and third successive positions, and third and fourth successive positions are less than the radius of said element adapted to engage said opening.

10. The apparatus of claim 8 wherein the distances between the center of said opening in said first and second successive positions, second and third successive positions, and third and fourth successive positions are less than half the width of said opening.

11. The apparatus of claim 10 wherein said distances between the center of said opening in said first and second successive positions, second and third successive positions, and third and fourth successive positions are less than the radius of said element adapted to engage said opening.

12. The apparatus of claim 1, wherein said opening is adapted to be positioned in one of four successive positions along the direction of the longitudinal axis of said body, for receiving said element, wherein the distances between the center of successive adjacent positions of said openings is less than the diameter of said element.

13. The apparatus of claim 12 wherein the distances between the centers of successive positions of said openings is also less than half the width of said openings.

14. The apparatus of claim 1 wherein said slot is positioned equidistantly from each longitudinal end of said body.

15. The apparatus of claim 1 wherein said frame is adapted to be rotated into first and second positions 180° apart, wherein when said frame is in said first and second positions, said opening is adapted to receive said element, whereby said first and second positions are positioned symmetrically on opposite sides of the transverse plane of symmetry of said body.

16. The apparatus of claim 8 wherein said body is oblong-shaped, and said slot is oblong-shaped.

17. The apparatus of claim 16 wherein said opening is circular, and said slot is oblong-shaped, having two arc-shaped portions at each end, wherein the radius of each arc-shaped end portion is equal to the radius of said opening.

18. The apparatus of claim 17 wherein said opening is located in one of said arc-shaped end portions of said slot.

19. The apparatus of claim 1 wherein said frame, said opening, and said slot are parallelepipedic in shape.

20. The apparatus of claim 8 wherein said frame further includes two projections, each of which extend laterally from opposite sides of said frame, perpendicular to the longitudinal axis of said frame, and are adapted to slidingly engage a slide opening in the side of said frame, wherein said frame is adapted to rotate around said projections, whereby, when said frame and opening rotates 180° from a first to a second position, said projections and said frame simultaneously move in longitudinal direction of said body.

21. The apparatus of claim 19 wherein said projections are cylindrical in shape and said slide openings are located approximately halfway between the bottom and top of said frame.

22. The apparatus of claim 20 wherein the length of said slide openings is slightly greater than the distance between the center of said opening in said first position, and the center of said opening in said second position.

23. The apparatus of claim 20 wherein said opening is circular and said slot is oblong-shaped, including two arc-shaped longitudinal ends having the same radius as said opening, said opening being located in one of said longitudinal ends, wherein the length of said slide openings is greater than the distance between the centers of said two arc-shaped ends of said slot.

24. The apparatus of claim 8 wherein said body is adapted to fit within a complementary shaped opening in a wall of the other of said members.

25. The apparatus of claim 1 in combination with a second adjustment apparatus, each attached to the other of said members on opposite sides thereof.

26. The apparatus of claim 1 wherein said body is adapted to be attached to said shank member, and said element is adapted to be attached to said shell base member.

27. A ski boot comprising:

(a) a stationary journal element;

(b) a shell base member;

(c) a shank member, journaled on said shell base member, by journalling on said journal element around a journal axis passing through said journal element, wherein said journal element is adapted to be attached to one of said members; and (d) an adjustment means for changing the orientation of said journal axis, comprising:

a body, attached to the other of said members, wherein said body has an opening therein for receiving said journal element, said body comprising means for changing the position of said opening without removal of said body from said other member thereby changing the orientation of said journal axis.

28. The boot of claim 27 wherein said body further comprises a slot therein, and a frame, adapted to be engaged in said slot and adapted to change its position therein, wherein said frame includes said opening therein.

29. The boot of claim 28 wherein said slot extends approximately along the longitudinal axis of said body, said frame having a volume less than the volume of said slot and said frame being adapted to rotate around an axis transverse to the longitudinal axis of said body.

30. The boot of claim 29 wherein when said frame rotates around said transverse axis, said frame is also adapted to be displaced in the longitudinal direction of said body simultaneously.

31. The boot of claim 30 wherein said opening is adapted to be moved between first and second positions spaced apart in the longitudinal direction of said body, wherein said opening is adapted to receive said element when said opening is in said first and second positions.

32. The boot of claim 31 wherein said first and second positions correspond to first and second positions of said frame in which the longitudinal axis of said frame is substantially parallel to the longitudinal axis of said body and said second position is obtained by rotating said frame over 180° from said first position.

33. The boot of claim 32 wherein said body is adapted to be attached to one of said members so that the longitudinal axis of said body is substantially vertical, whereby said first and second positions of said opening are substantially vertically spaced from one another.

34. The boot of claim 33 wherein said body has two longitudinal ends and said slot is adapted to be positioned closer to one longitudinal end of said body than the other longitudinal end of said body.

35. The boot of claim 34 wherein said body is adapted to be placed in a housing in one of said members, wherein said body has front and rear longitudinal ends and is adapted to be removed from said housing and is adapted to be replaced in said housing with the position of said front and rear longitudinal ends reversed, whereby said opening can be positioned in first, second, third, or fourth successive positions along the longitudinal direction of said body.

36. The boot of claim 35 wherein the distances between the center of said opening in said first and second successive positions, second and third successive positions, and third and fourth successive positions are less than the radius of said element adapted to engage said opening.

37. The boot of claim 35 wherein the distances between the center of said opening in said first and second successive positions, second and third successive positions, and third and fourth successive positions are less than half the width of said opening.

38. The boot of claim 37 wherein said distance between the center of said opening in said first and second successive positions, second and third successive positions, and third and fourth successive positions are less than the radius of said element adapted to engage said opening.

39. The boot of claim 27 wherein said opening is adapted to be positioned in one of four successive positions along the direction of the longitudinal axis of said body, for receiving said element, wherein the distances between the center of successive adjacent positions of said openings is less than the diameter of said element.

40. The boot of claim 39 wherein the distances between the centers of successive positions of said openings is also less than half the width of said openings.

41. The boot of claim 28 wherein said slot is positioned equidistantly from each longitudinal end of said body.

42. The boot of claim 41 wherein said frame is adapted to be rotated into first and second positions, 180° apart, wherein when said frame is in said first and second positions, said opening is adapted to receive said element, whereby said first and second positions are positioned symmetrically on opposite sides of the transverse plane of symmetry of said body.

43. The boot of claim 35 wherein said body is oblong-shaped, and said slot is oblong-shaped.

44. The boot of claim 43 wherein said opening is circular, and said slot and frame are oblong-shaped, having two arc-shaped portions at each end, wherein the radius of each arc-shaped end portion of said frame is equal to the radius of said opening.

45. The boot of claim 44 wherein said opening is located in one of said arc-shaped end portions of said slot.

46. The boot of claim 28 wherein said frame, said opening, and said slot are parallelepipedic in shape.

47. The boot of claim 35 wherein said frame further includes two projections, each of which extend laterally from opposite sides of said frame, perpendicular to the longitudinal axis of said frame, and are adapted to slidingly engage a slide opening in the side of said frame, wherein said frame is adapted to rotate around said projections, whereby, when said frame and opening rotates 180° from a first to a second position, said projections and said frame simultaneously move in longitudinal direction of said body.

48. The boot of claim 46 wherein said projections are cylindrical in shape and said slide openings are located approximately halfway between the bottom and top of said frame.

49. The boot of claim 47 wherein the length of said slide openings is slightly greater than the distance between the center of said opening in said first position, and the center of said opening in said second position.

50. The boot of claim 47 wherein said opening is circular and said slot is oblong-shaped, including two arc-shaped longitudinal ends having the same radius as said opening, said opening being located in one of said longitudinal ends, wherein the length of said slide openings is greater than the distance between the centers of said two arc-shaped ends of said slot.

51. The boot of claim 35 wherein said body is adapted to fit within a complementary shaped housing in a wall of one of said members.

52. The boot of claim 51 wherein said housing is in the shape of a cross, having horizontal and vertical portions, wherein said horizontal and vertical portions are each complementary shaped with respect to said body.

53. The boot of claim 51 wherein housing is in the shape of a T, having horizontal and vertical portions, wherein said portions are each complementary to the shape of said body.

54. The boot of claim 27 in combination with a second adjustment apparatus, each attached to one of said members on opposite sides thereof.

* * * * *